United States Patent [19]

Bessi

[11] 3,979,927

[45] Sept. 14, 1976

[54] KNITTING MACHINES

[76] Inventor: Giovanni Bessi, Via Labriola 25, Prato, Florence, Italy, I-50047

[22] Filed: June 6, 1975

[21] Appl. No.: 584,293

[30] Foreign Application Priority Data

June 12, 1974 Italy ..... 9477/74

[52] U.S. Cl. ..... 66/9 R; 66/190; 66/17; 66/13

[51] Int. Cl.[2] ..... D04B 9/12; D04B 9/14; D04B 9/16; D04B 9/44

[58] Field of Search ..... 66/17, 125, 19, 7, 8, 66/9, 10, 11, 13, 31, 135

[56] References Cited

UNITED STATES PATENTS

| | | | |
|---|---|---|---|
| 627,786 | 6/1899 | Waterfield | 66/10 |
| 732,434 | 6/1903 | Nicholls | 66/10 |
| 1,874,198 | 8/1932 | Larmour | 66/7 |
| 2,312,965 | 3/1943 | Guyler et al. | 66/8 |
| 3,832,867 | 9/1974 | Luchi | 66/17 |

*Primary Examiner*—Ronald Feldbaum
*Attorney, Agent, or Firm*—McGlew and Tuttle

[57] ABSTRACT

A flat bed or circular knitting machine has an additional bed which accommodates in grooves or tricks pairs of yarn-guide members which are controlled alternatively by cams to co-operate with needles of the machine. The ends of each yarn-guide member carries a hook which co-operates with an eyelet to effect the actual guiding function.

5 Claims, 28 Drawing Figures

XVIII
T2
TV1

M1
TO
TV2 TV1

M1
TO

XVIII
XIX

TO
M1
TV1
TV2
XIX

TV2 TV1
TO
M1

KNITTING MACHINES

BACKGROUND OF THE INVENTION

This invention relates to knitting machines for producing knitted articles incorporating warp yarns and possibly also weft yarns. The invention is applicable to both flat bed and circular knitting machines.

SUMMARY OF THE INVENTION

According to the present invention there is provided in a knitting machine means defining a needle bed, combined needles and jacks movable in the bed, sinkers arranged to co-operate with the needles, means defining guides for knitting yarn, and means defining guides for weft yarn, the improvement wherein there is provided means defining an additional bed, a pair of yarn supply members slidably mounted on the additional bed and interdigitated with respect to a contiguous pair of needles, yarn guides mounted on the yarn supply members so arranged that the guides can move to the front of the needles, wedge means mounted on the additional bed for resiliently diverging the individual members of each pair of yarn supply members, and control means for controlling operation of said wedge means according to a required program.

BRIEF DESCRIPTION OF THE DRAWINGS

The invention will now be described, by way of example, with reference to the accompanying diagrammatic drawings, in which.

DESCRIPTION OF THE PREFERRED EMBODIMENT

Figure 1:
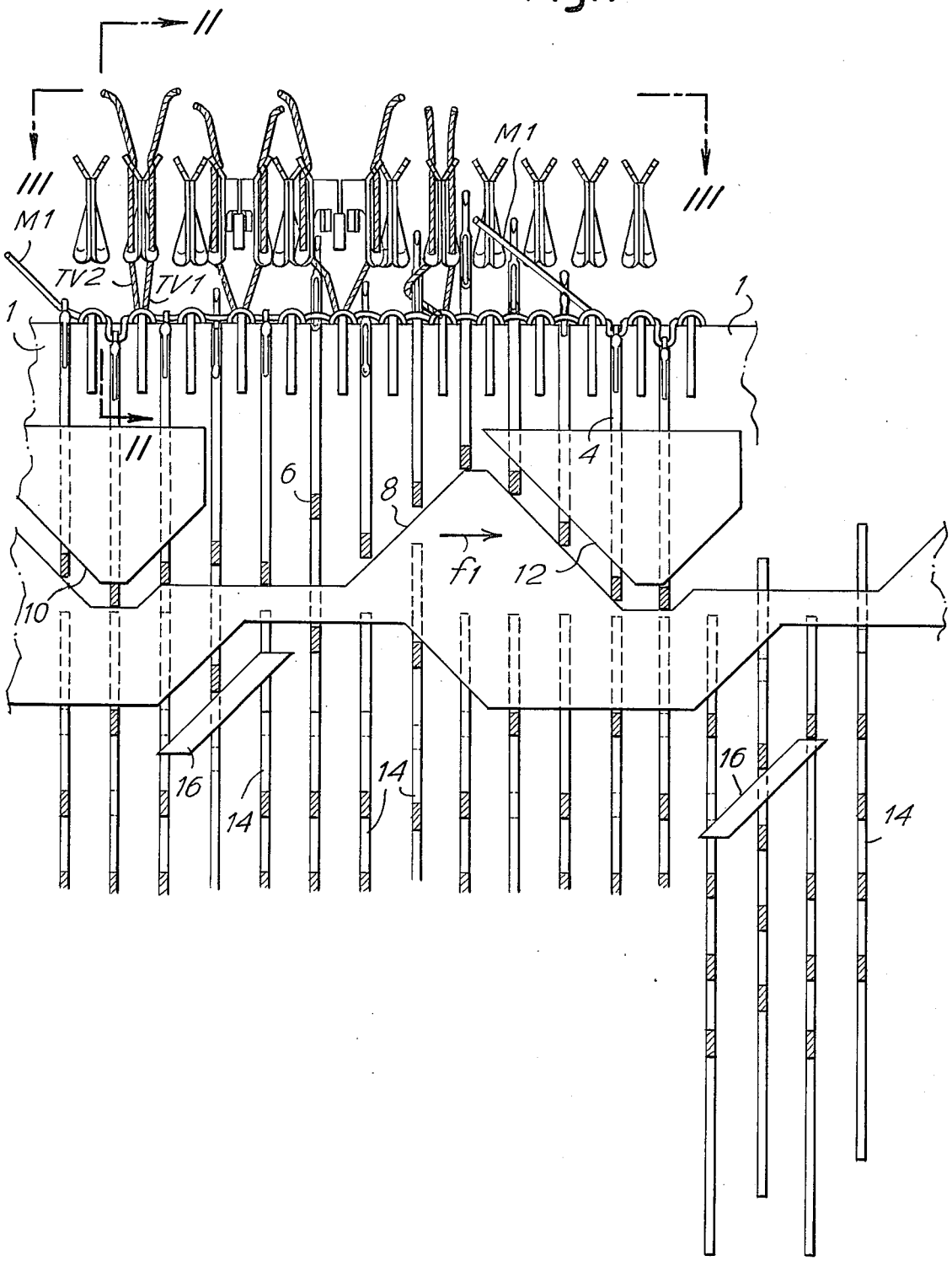
FIG. 1 is a fragmentary front elevation of the needle bed corresponding to two feeds (for a circular machine this view can be considered as a developed view of a portion of the needle cylinder)
Figure 2:
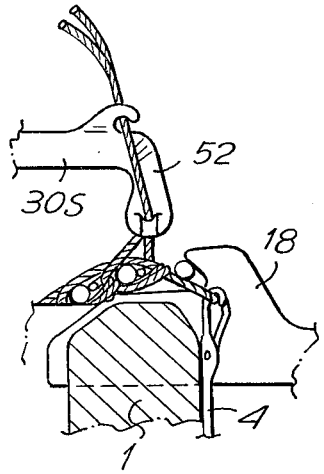
FIG. 2 is a local section on line II—II of FIG. 1.
Figure 3:
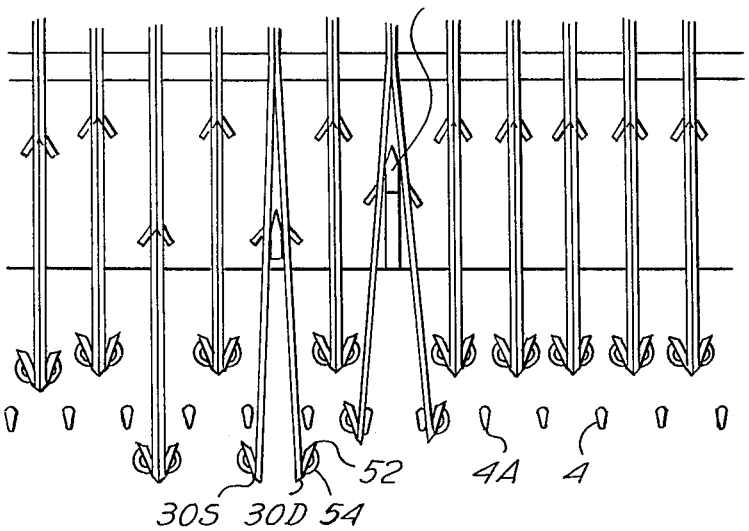
FIG. 3 is a plan as viewed from line III—III of FIG. 1.

Referring to the drawings and in particular to FIGS. 1 to 15, the knitting machine includes a needle carrying-bed and needles 4 slidable therein. The bed may be either flat or cylindrical, and in the latter event the views shown can be considered as developments of the needle cylinder. To control the needles, butts 6 of the needles co-operate with raising cam profiles 8 (FIG. 1) and with lowering cam profiles 10 and 12. In addition the needles can be operated by underlying jacks 14, provided with butts of several types and with different arrangements to co-operate with cams 16 to effect the desired needle selections, according to criteria known per se. These selections can be effected by several cams, with several rows of butts on the jacks and with butts having an appropriate distribution in the various rows. For those skilled in the art, an indication of the desired way of selecting the needles, is sufficient to establish the actually required arrangement of the insertion and disengagement controls of the cams, to obtain the desired selection with the aid of the jacks.

Figure 7:
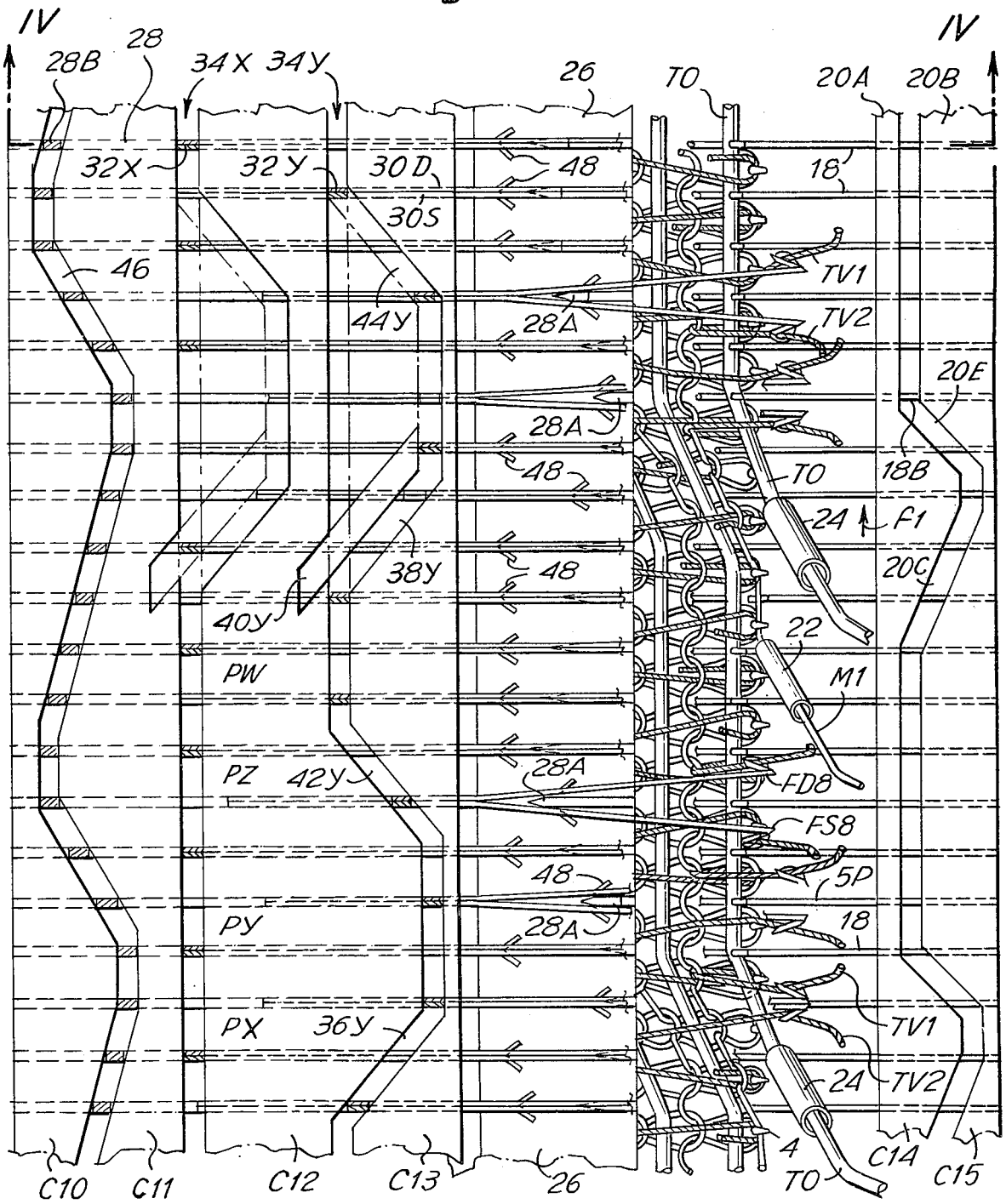
FIG. 7 is a plan view of FIG. 4.
Figure 8:
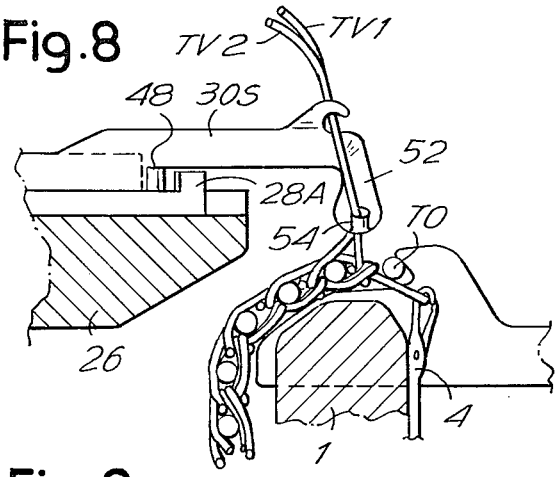
FIGS. 8 and 9; 10 and 11; 12 and 13; 14 and 15 respectively illustrate in cross-section and in plan view, limited to a pair of yarn supply members, different positions of various elements of the machine to form an interlaced knit fabric.
Figure 10:
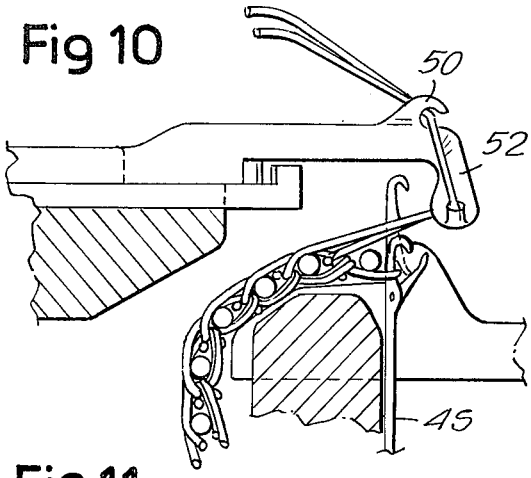
Figure 9:
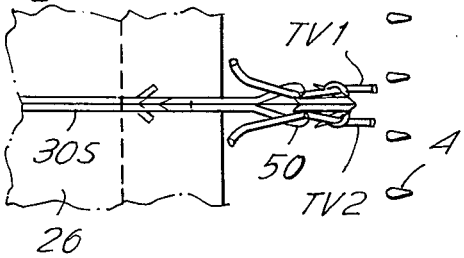
Figure 11:
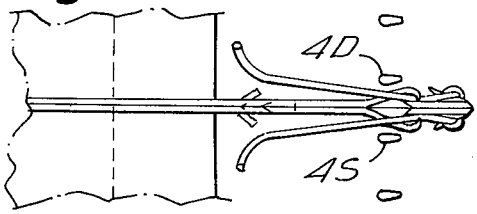

Between one needle 4 and the next, a sinker 18 is provided having a tip 18A (FIGS. 4 and 12) arranged to act on the fed yarns and a butt 18B which co-operates with cam profiles 20A, 20B, shaped as seen in FIG. 7 with inclined control cam profile 20C for moving the sinkers away from the needles and profile 20E for the interdigitation of the tip of each sinker between the needles.

Yarn-guides 22 and 24 are arranged successively in the direction of relative movement of the needles, each corresponding to one of the profiles 20C and 20E. The yarn-guides 22 feed yarn M1 for binding plain knitting while the yarn-guide 24 feeds a weft yarn T0, which is thicker. Additional yarn-guides are provided, for an overall or partial utilization, in pairs for each needle, and each is arranged in a fixed position with respect to the needles, to feed warp or vertical weft yarns, indicated by TV1 and TV2.

Figure 4:
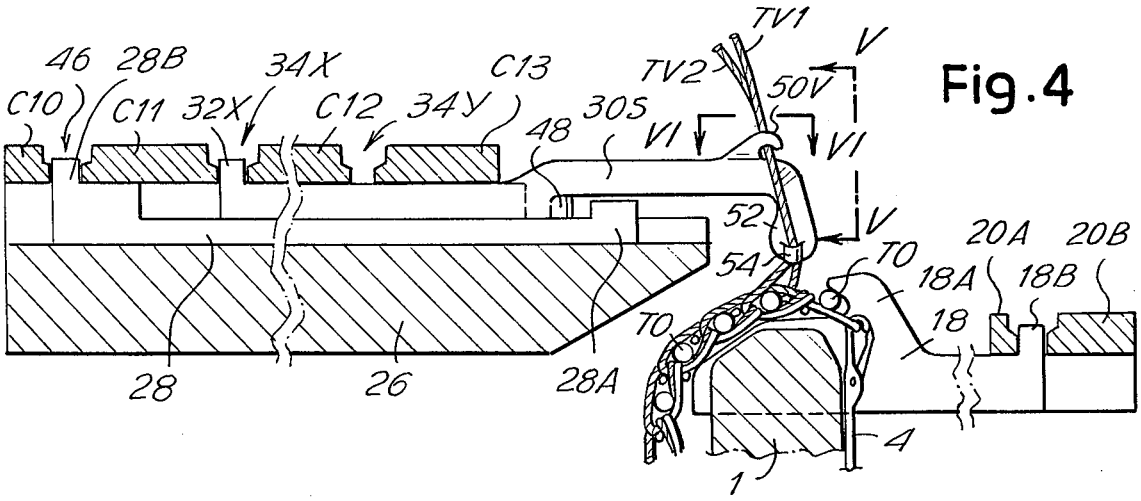
FIG. 4 is a section similar to that of FIG. 2 but showing further details, the section being taken on the line IV—IV of FIG. 7.
Figure 5:
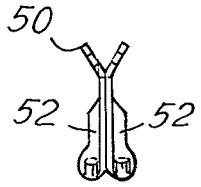
FIGS. 5 and 6 are respectively an axial view and a plan view of the ends of a sinker, as viewed from lines V—V and VI—VI of FIG. 4.
Figure 6:
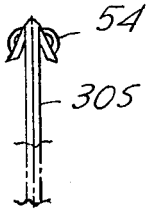

An additional front or bed 26 is provided lying normally to the bed 1 and spaced therefrom so that between the two beds, fabric can pass (see FIG. 4).

In the front or bed 26, provided with grooves substantially corresponding to the sinkers 18, a total of three movable members is provided. In the bottom section of each groove a slide member 28 can slide, including a wedge 28A at the end thereof next the needle bed, and including a control butt 28B on the opposite end. The tip of the wedge 28A is directed towards the butt 28B, that is on the opposite side of the needle bed.

Above the wedge member 28 in each groove left and right hand yarn supply members 30S and 30D are mounted. These supply members 30S and 30D are symmetrical with respect to a common plane, one being on the left and the other on the right. Each member 30 has a control butt; the butts 32X of alternate pairs of supply members 30 are aligned according to a different alignment from that of butts 32Y of the other pairs of supply members 30, so that the butts 32X (even number location) substantially cooperate with a profiled channel 34X and the butts 32Y (odd number location) co-operate with a profiled channel 34Y. Each of the two channels 34X and 34Y may have ramps to advance the members 30 such as 36Y and 38Y of the channel 34 (the latter ramp being formed by a cam 40Y).

In FIG. 7 the channel 34X is assumed to be rectilinear and the channel 34Y is provided with ramps to advance the members 30 and with corresponding retracting ramps 42Y and 44Y. The channels 34Y, 34X, and the channel 46 for the butts 28B may be formed above the front or bed 26 by members indicated in the drawing (FIG. 7) by C10, C11, C12 and C13.

The yarn supply member 30S and 30D corresponding to one of their upwardly directed deviations have fins 48 outwardly-diverging to form a V-shaped seat arranged to co-operate with the respective wedge 28A. Towards the end, each yarn supply member 30 has a hook extension 50 functioning as a yarn-guide, and is slightly bent away from the plane of the member. Each yarn supply member terminates moreover in a downwardly extending extension 52, having an inclination away from the plane of the member and is provided with eyelets 54 for the passage of the yarn TV2, TV1 respectively.

Figure 12:
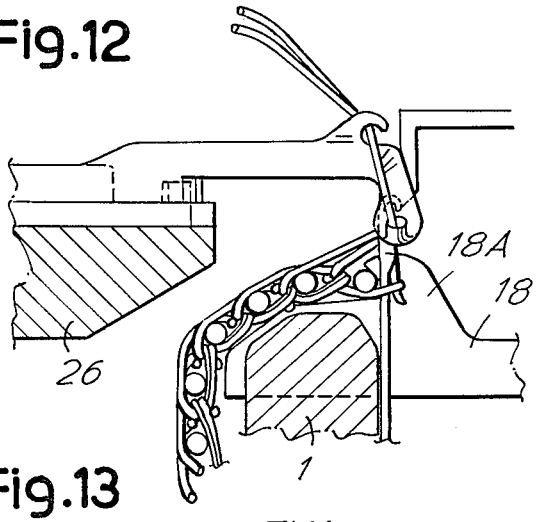
Figure 14:
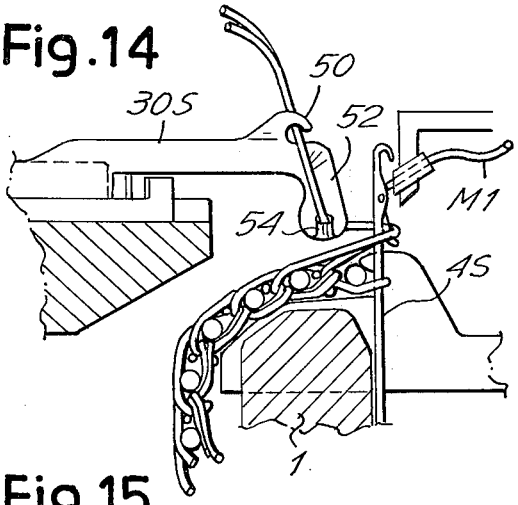
Figure 13:
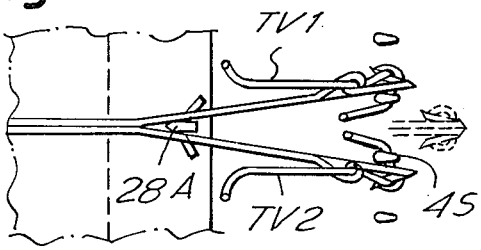
Figure 15:
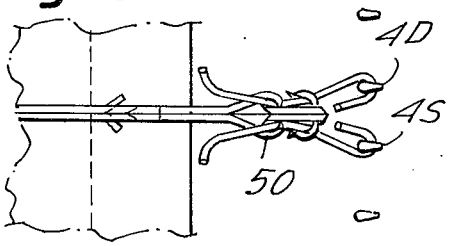

The operation of the assemblies 28, 30S and 30D, when actuated by the respective butts sliding in the channels 46, 34X and 34Y is as follows:

Under starting conditions (see FIGS. 8 and 9) the yarn supply members 30S and 30D are located in a retracted position that is, they lie to the rear of the row of needles 4. The wedges 28A are located in the bed and slightly spaced from the fins 48. The yarn supply members, owing to their own elasticity contact one another at the roots of the extensions 52, and divergence of these extensions is due only to their relaxed condition. Under these conditions a pair of yarn supply members can be advanced by means of the ramps 36Y and 38Y of the channel 34Y, or of the corresponding ramps of the channel 34X, and almost simultaneously or in advance also the slide member 28 and thus the wedge 28A are caused to advance. Under these conditions, the extensions 52 still adjacent one another at their roots, advance to the front of the row of needles (see FIGS. 10 and 11) passing between one needle and the next, that is between the needles indicated by 4S and 4D in FIGS. 11, 13 and 15. By the action of the return ramp of the channel 46, the wedge 28A is then retracted and in this way, acting on the fins 48, causes resilient divergence of the projecting portions of the yarn supply members 30S and 30D, as shown in FIGS. 12 and 13. The extensions 52 are thereby moved outside the needles 4S, 4D, considered as a pair, and thus the outside of the gap formed by the needles.

In the meanwhile, according to a selection desired, the needles can be raised completely or partially and thus in the embodiment illustrated, both the needles 4S and 4D, or only one thereof may have been raised, this depending upon the article to be produced. In the diverged configuration of the yarn supply members they may be retracted with the extensions 52 on the outside of the pair of needles 4S and 4D, by means of the ramps 42Y or 44Y, while simultaneously the wedge 28A is retracted by the corresponding ramp of the channel 46. Consequently, a yarn TV1 and/or TV2, which is carried by the members 50, 54 of a yarn supply member 30S or 30D, is brought in close proximity to the needle which has been raised, such as the needle 4S of FIGS. 12 to 15, above the latch of the raised needles. The yarns TV1 and/or TV2 remain engaged by the needles (even if the latter come down and then go up without being cleared), while these needles all take up a knitting yarn such as M1. The needles, in particular, may be relevelled and again raised in order that all take up the knitting yarn M1.

Restriction of the yarn supply members 30S and 30D, besides the stopping of the wedge 28A, determines the mutual resumption of the rest condition in which the members lie close to one another.

An operation of advance, diverging and retraction and thus of return of the yarn supply members 30S and 30D to their rest condition can be accomplished by alternate pairs in front of the several yarn feeds, with selection possibilities afforded by the channels 34X and 34Y, while the control of the wedge 28A can be repeated for all the pairs of carrier members, being inactive if not accompanied by the described movement of the yarn supply members of the respective pair. In fact the return to the rest condition of the yarn supply means takes place when the latter fully retract subsequently to the withdrawal of the wedge, whereby the wedge loses the contact with the fins which still have to complete retraction.

It will be apparent that the deposit of a yarn TV1 or TV2 in front of the respective needle can be selected both as a function of the raising or of the missed raising of the corresponding needle, and as a function of the advance or missed advance of the supply member or better of the pair of corresponding supply members, still as a function of the presence or absence of the yarn in the yarn engaging elements 50 and 54 of the supply member considered. With these selections it is possible to obtain different distribution conditions of the warp (or vertical weft) yarns TV1, TV2, to obtain articles with different interlacings (or patterns) as hereinafter indicated.

In order to better appreciate the formation of an interlacing, FIG. 7 is to be considered, in which a portion of the machine is shown, in which two consecutive feeds are provided. At the zone PX, the needles 4 are still low and the stitch is cleared; the sinker 18 is at its retracted position, while the yarn supply members are in the advanced stage (according to this embodiment, by the action of the ramp 36Y formed by the profiles C12 and C13), also the wedge 28, 28A being caused to advance by the ramp of the channel 46 formed by the profiles C10 and C11.

In the zone PY, the sinker 18 has advanced by the action of the ramp 20E (formed by the profiles C14 and C15) and has located the weft yarn T0 (supplied by the yarn-guide 24) behind the needles (also see FIG. 4), the needles still being low. The yarn supply members 30S and 30D have already been advanced with the extensions 52 in front of the needles and are about to be diverged. It is to be noted that the control of the yarn supply members 30S and 30D is operated according to alternate pairs and thus one pair remains retracted and the other one is caused to advance by the ramp 36Y.

In the passage from the zone PY to the zone PZ, the needles have been raised and the weft yarn PO is kept by the sinkers 18 behind the needles, while after raising of the needles (raising is selected by the controls operated for example by the jacks 14) the retraction of wedge 28A is initiated, and the wedge diverges the extensions 52, acting on the fins 48 of the advanced pair of yarn supply members. In this manner, the yarns TV1 and/or TV2 which are carried by the extensions 52, are wound in front of the needles and on the latches of the raised needles.

In the zone PW, the previously advanced supply members 30S and 30D are retracted and are closed, that is are brought towards one another behind the needles, so that the yarns TV1 and/or TV2, which have been engaged by respective selectively raised needles remain engaged by the needles hooks, clearing the loop of the stitch and the knot formed by the warp yarns TV1 and/or TV2. Before the lowering of the needles or in a subsequent stage by the action of a fresh raising of the needles, the knitting yarn M1 is fed, which is fed in every case when all the needles have been raised, apart the previous solution, in order to form with the yarn M1 a plain stitch.

As already stated previously, different fabrics are obtained through the selection possibilities afforded by the jacks 14, through the control arrangements of the yarn supply members 30S and 30D, through the arrangement of the yarns TV1 and TV2 (for example, on all the pairs, on one pair and one not, on member 30S and not on member 30D, or on member 30D and not member 30S, or on a right-hand supply member of a pair and on the left-hand one of the adjacent ones) and through possible additional conditions, for example also of selection or not of the needles to keep the weft T0 in certain zones in front of the needles rather than behind them.

One example of a knit fabric produced is illustrated in FIGS. 16 to 19, which respectively illustrate the front and the back and lateral views of the fabric. The yarns TV1 and TV2 are supplied to all the pairs of the supply members, which however at each feed cause one pair to advance and the next one to remain retracted, and exchange at the subsequent feed (in a feed, the even number pairs and in the subsequent, the odd number pairs); in this manner all the needles have two yarns TV1 and TV2 crossed and alternated one with respect to the other, for one course of stitches.

Figures 16, 17, 18, 19, 20, 21:
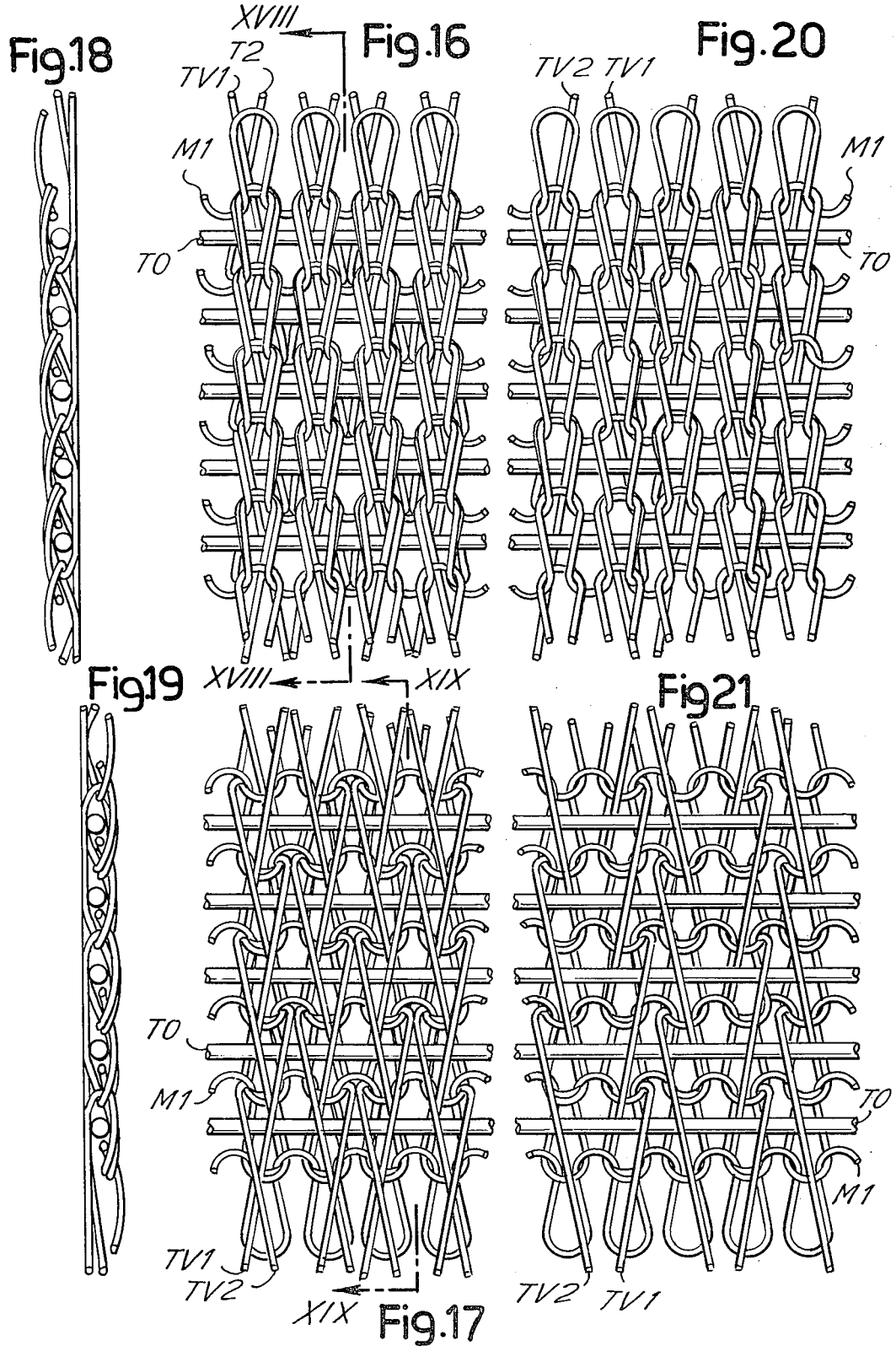
FIGS. 16, 17, 18 and 19 illustrate a first knit fabric produced on a machine in accordance with the invention in the two views, namely front and back of the fabric and in the sections on the lines XVIII—XVIII of FIG. 16 and XIX—XIX of FIG. 17.
FIGS. 20 and 21 show another form of knit fabric, respectively from the back and the front.
Figure 24:
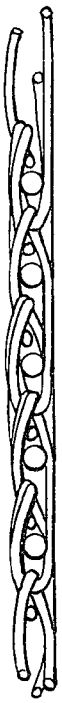
FIGS. 22, 23, 24 and 25 illustrate the front and back views and also two sections of a further knit fabric.
Figure 22:
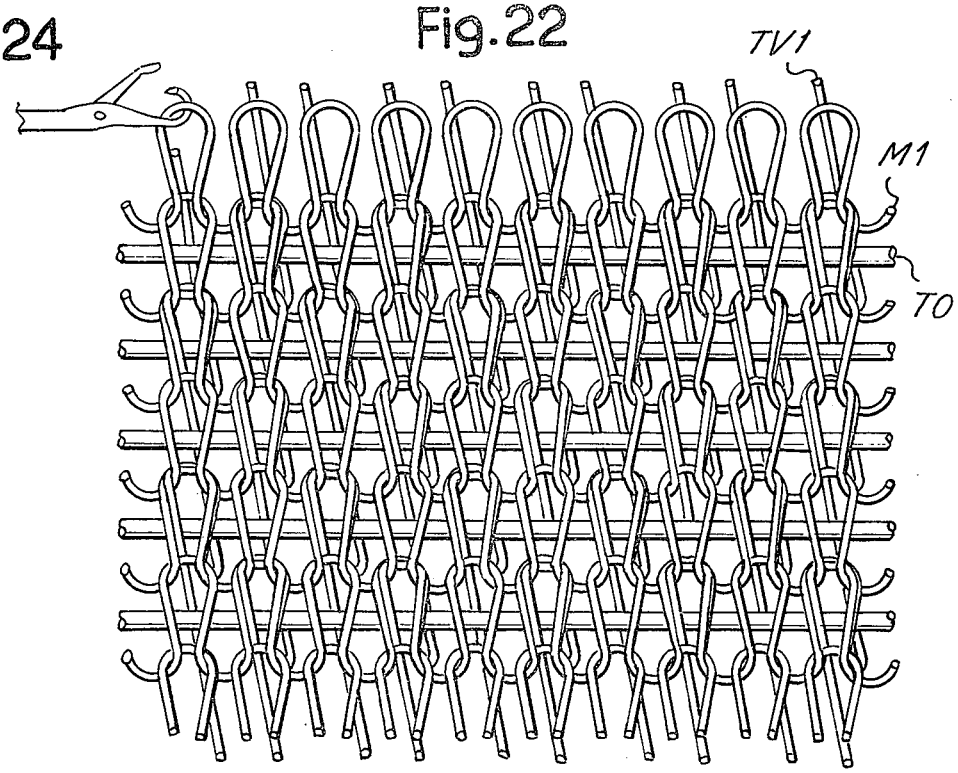
Figure 25:
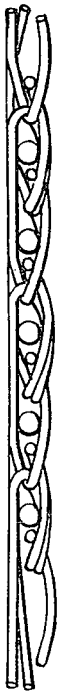
Figure 23:
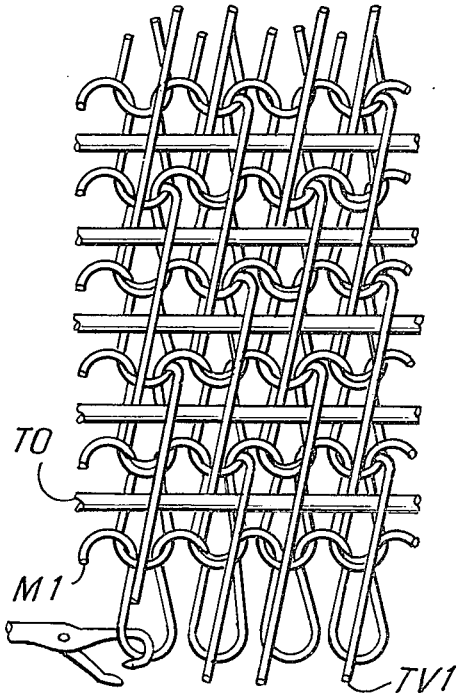

In FIGS. 20 and 21, which respectively illustrate the front and the back of another knit fabric, the supply members are fed with the yarns TV1 and TV2, one pair being fed and the other one not being fed, and the needles are selected a top one and a bottom one, always offset one with respect to the other from one course of stitches to the next.

In FIGS. 22 to 25 which respectively illustrate the front and the back and lateral views of another knit fabric, in each pair of supply members 30S and 30D, there is a single yarn TV1 which feeds the only supplier 30D and the needles are selected, a top one and a bottom one, alternate and always offset one from the other in each course of stitches or loops. In an alternative, the supply member 30S with the yarn TV2 may be used.

Figure 26:
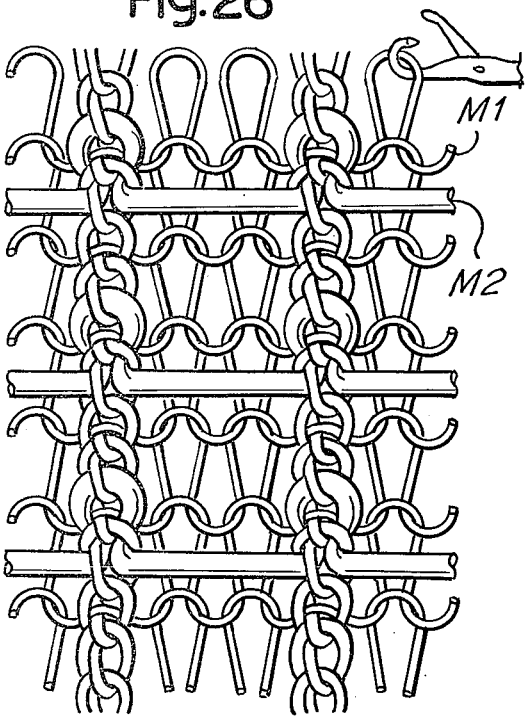
FIGS. 26, 27 and 28 illustrate additional knit fabrics which can be obtained by a knitting machine in accordance with the invention.

In FIG. 26 a portion of an article is illustrated which is produced by means of the following working steps. A feed is arranged for the formation of a course formed by a thick thread M2, a top needle and two low ones with the same arrangement as in the forming of plain stitch. At the contiguous feed, the subsequent course is formed by the selection of two top needles and a low one, which take up the yarn M1 from the yarn-guide G1. At the contiguous feed there is formed a third course by means of the arrangement of a top needle and two low ones, fed by the supply member 30D with the yarn TV1 or indifferently by the supply member 30S with the yarn TV2. At the still contiguous feed the subsequent course is set up by the selection of two top needles and a low one, which pick up the yarn M1 from the yarn-guide G1. By repeating the above indicated steps, the knit fabric shown in FIG. 26 is produced.

Figure 27:
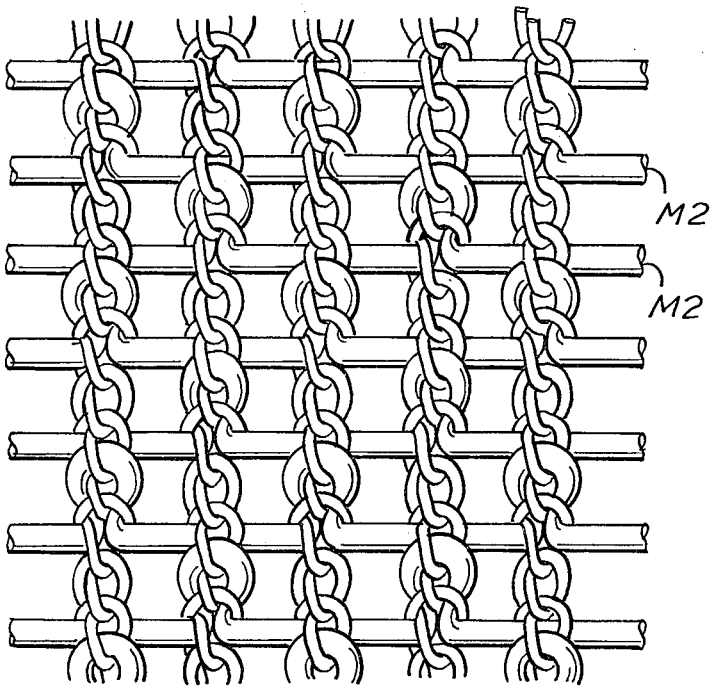
Figure 28:
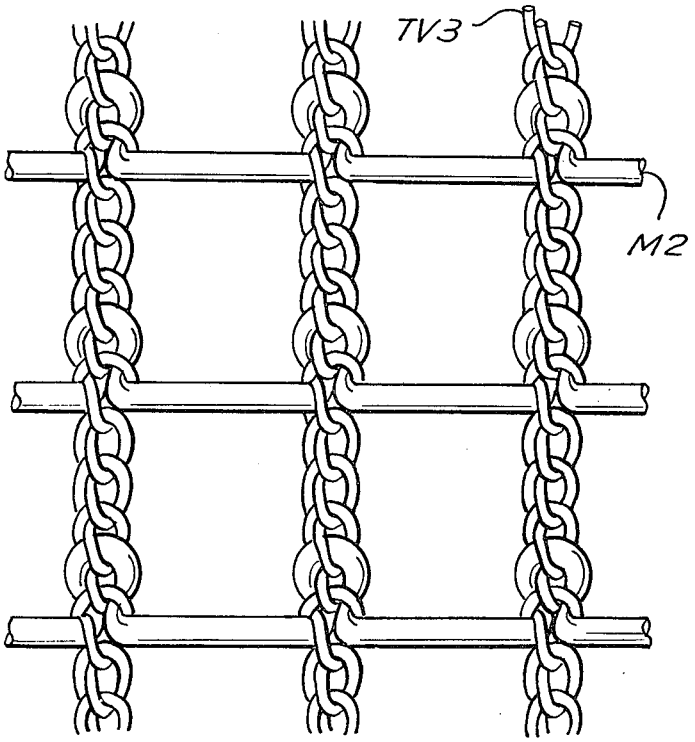

In FIGS. 27 and 28 there are shown further variations of the knit fabric including the possibility of producing without the introduction of the yarn M1, but of only yarns M2 and of warp yarns TV3 such as those indicated by TV1 or TV2.

I claim:

1. In a knitting machine
means defining a needle bed,
combined needles and jacks movable in the bed,
sinkers arranged to co-operate with the needles,
means defining guides for knitting yarn, and
means defining guides for weft-yarn,
the improvement wherein there is provided
means defining an additional bed,
a pair of yarn supply members slidably mounted on the additional bed and interdigitated with respect to a contiguous pair of needles,
yarn guides mounted on the yarn supply members so arranged that the guides can move to the front of the needles,
wedge means mounted on the additional bed for resiliently diverging the individual members of each pair of yarn supply members, and
control means for controlling operation of said wedge means according to a required program.

2. A machine according to claim 1, wherein the wedge means serve positively to effect divergence of the yarn supply members and the inherent resilience of these members serves to return them to their rest condition.

3. A machine according to claim 1, wherein the yarn supply members extend generally normally to the needle bed, the end of each member adjacent the needle bed comprising an angled portion whereby the end portions can be presented in front of needles, when raised, until below the lay of the yarn supply members.

4. A machine according to claim 1, wherein said additional bed comprises a plurality of grooves, each of which grooves accommodates one pair of yarn supply members and one said wedge means, said control means comprising first and second cams operable to control movement of the yarn supply members in alternate grooves.

5. A machine according to claim 1, wherein the yarn guides of the yarn supply members each comprise
a hook bent out of the plane of the member as a whole and having an eyelet for receiving the yarn.

* * * * *